US007942392B2

(12) United States Patent
Geier et al.

(10) Patent No.: US 7,942,392 B2
(45) Date of Patent: May 17, 2011

(54) RELEASE EXPLOSION DAMPER

(75) Inventors: Manfred Geier, Puchhelm (DE); Ralf Strauβ, Wörthsee (DE)

(73) Assignee: Irwin Industrial Tool Company GmbH, Hallbeergmoos (DE)

( * ) Notice: Subject to any disclaimer, the term of this patent is extended or adjusted under 35 U.S.C. 154(b) by 770 days.

(21) Appl. No.: 10/572,607

(22) PCT Filed: Mar. 12, 2005

(86) PCT No.: PCT/EP2005/005193

§ 371 (c)(1),
(2), (4) Date: Mar. 20, 2006

(87) PCT Pub. No.: WO2005/113199

PCT Pub. Date: Dec. 1, 2005

(65) Prior Publication Data

US 2008/0179801 A1 Jul. 31, 2008

(30) Foreign Application Priority Data

May 19, 2004 (DE) ..... 10 2004 024 862

(51) Int. Cl.
*B25B 5/00* (2006.01)

(52) U.S. Cl. ..... 269/6; 269/3; 269/166

(58) Field of Classification Search ..... 269/6, 3, 269/166–170, 226, 227, 225, 61, 204; 81/487
See application file for complete search history.

(56) References Cited

U.S. PATENT DOCUMENTS 4,381,105 A 4/1983 Goff et al.
4,563,921 A 1/1986 Wallace
4,850,254 A 7/1989 Burney
4,874,155 A 10/1989 Goul
4,893,801 A 1/1990 Flinn (Continued)

FOREIGN PATENT DOCUMENTS

FR 2611160 7/1994

(Continued)

OTHER PUBLICATIONS

International Patent Application No. PCT/EP2005/005193, International Preliminary Report on Patentability, dated Jul. 25, 2005.

(Continued)

*Primary Examiner* — Lee D Wilson
(74) *Attorney, Agent, or Firm* — Matthew W. Witsil; Dennis J. Williamson; Moore & Van Allen, PLLC

(57) ABSTRACT

A clamping and/or spreading tool comprising a push or pull rod to which a mobile jaw is fixed, a fixed jaw, a gear mechanism which can be used to move the mobile jaw towards or away from the fixed jaw by moving the push or pull rod in a clamping or spreading direction, and to apply clamping and/or bracing forces between the jaws, and a lock used to block movement of the push or pull rod in an opening direction opposing the clamping or spreading direction, in order to maintain clamping and/or spreading forces produced between the jaws. A mechanism for dissipating the stored clamping and/or spreading forces enables an absorption movement of the push or pull rod in the opening direction along a pre-determined absorption course, and especially detachably blocks an absorption movement of the push or pull rod over the predetermined absorption course, in the opening direction.

29 Claims, 5 Drawing Sheets

U.S. PATENT DOCUMENTS

| | | | | |
|---|---|---|---|---|
| 4,926,722 | A | 5/1990 | Sorensen et al. | |
| 4,989,847 | A | 2/1991 | Chapman | |
| 5,005,449 | A | 4/1991 | Sorensen et al. | |
| 5,009,134 | A | 4/1991 | Sorensen et al. | |
| 5,022,137 | A | 6/1991 | Sorensen et al. | |
| D320,919 | S | 10/1991 | Sorensen | |
| 5,094,131 | A | 3/1992 | Sorensen et al. | |
| 5,096,170 | A | 3/1992 | Albin | |
| D328,846 | S | 8/1992 | Sorensen et al. | |
| 5,161,787 | A | 11/1992 | Hobday | |
| 5,170,682 | A | 12/1992 | Sorensen et al. | |
| D333,963 | S | 3/1993 | Goodman | |
| 5,197,360 | A | 3/1993 | Wooster, Jr. | |
| 5,217,213 | A | 6/1993 | Lii | |
| 5,222,420 | A | 6/1993 | Sorensen et al. | |
| 5,454,551 | A | 10/1995 | Hobday | |
| D366,819 | S | 2/1996 | Wooster, Jr. et al. | |
| D366,820 | S | 2/1996 | Wooster, Jr. et al. | |
| 5,775,680 | A | 7/1998 | Sorensen et al. | |
| 5,826,310 | A | 10/1998 | Hobday | |
| 5,853,168 | A | 12/1998 | Drake | |
| 5,988,616 | A | 11/1999 | Fuller et al. | |
| 6,302,386 | B1 | 10/2001 | Fuller et al. | |
| 6,338,475 | B1 | 1/2002 | Ping | |
| 6,347,791 | B1 | 2/2002 | Chervenak | |
| 6,367,787 | B1 | 4/2002 | Poole et al. | |
| 6,382,608 | B1 | 5/2002 | Michell | |
| 6,386,530 | B1 | 5/2002 | Marks | |
| 6,412,767 | B1 | 7/2002 | Beckmann et al. | |
| 6,474,632 | B1 * | 11/2002 | Liou | 269/6 |
| 6,564,703 | B1 * | 5/2003 | Lin | 100/234 |
| 6,578,837 | B1 * | 6/2003 | Blank et al. | 269/6 |
| 6,585,243 | B1 * | 7/2003 | Li | 269/6 |
| 6,655,670 | B1 * | 12/2003 | Liou | 269/6 |
| 6,860,179 | B2 | 3/2005 | Hopper et al. | |
| 6,929,253 | B2 * | 8/2005 | Marks | 269/6 |
| 6,966,550 | B2 * | 11/2005 | Marks | 269/6 |
| 7,017,894 | B1 * | 3/2006 | Lin | 269/6 |
| 7,090,209 | B1 | 8/2006 | Rowlay | |
| 7,131,642 | B1 | 11/2006 | Rowlay et al. | |
| 7,172,183 | B1 * | 2/2007 | Yang | 269/6 |
| 7,322,085 | B1 * | 1/2008 | Benson | 29/237 |
| 7,624,974 | B2 | 12/2009 | Zheng | |
| 7,784,774 | B2 * | 8/2010 | Fuller et al. | 269/6 |
| 2004/0075205 | A1 * | 4/2004 | Marks | 269/6 |
| 2004/0195746 | A1 | 10/2004 | Marks | |
| 2005/0082728 | A1 * | 4/2005 | Cicenas et al. | 269/6 |
| 2007/0194510 | A1 * | 8/2007 | Geler et al. | 269/6 |
| 2007/0246874 | A1 * | 10/2007 | Fuller et al. | 269/6 |
| 2008/0029944 | A1 * | 2/2008 | Avalani | 269/6 |
| 2008/0136077 | A1 * | 6/2008 | Yang | 269/6 |
| 2008/0179801 | A1 * | 7/2008 | Geier et al. | 269/6 |

FOREIGN PATENT DOCUMENTS

| | | |
|---|---|---|
| TW | 136083 | 6/1990 |
| WO | 2003/013793 A | 2/2003 |
| WO | WO 03/013793 A1 | 2/2003 |

OTHER PUBLICATIONS

International Patent Application No. PCT/EP2005/005193, Written Opinion, dated Jul. 25, 2005.

International Patent Application No. PCT/EP2005/005193, International Search Report, dated Jul. 27, 2005.

"Pony Steel Bar Clamp Fixtures" styles 50, 52 and 56. Publication source and date unknown. It is believed that this publication was available to the public prior to Jul. 15, 1993.

Bessey Steel Bar Clamp Fixture RS 75 instructions. Publication source and date unknown. It is believed that this publication was available to the public prior to Jul. 15, 1993.

Advertisement for Bessey Bar Clamps Styles 52, 53 and 56. Publication source and date unknown. It is believed that this publication was available to the public prior to Jul. 15, 1993.

Advertisement for Bessey Bar Clamps Styles 43 and 45. Publication source and date unknown. It is believed that this publication was available to the public prior to Jul. 15, 1993.

Advertisement for Gross Stabil Clamp. Publication source and date unknown. It is believed that this publication was available to the public prior to Jul. 15, 1993.

"Pony Clamp Fixtures" styles 50, 52, 53 and 56. "Jorgensen Style 3400 Aluminum Bar Clamps". "Jorgensen Style 7200 Steel I-Bar Clamps". Publication source and date unknown. It is believed that this publication was available to the public prior to Jul. 15, 1993.

"Catalog-American Tool Companies, Inc.," advertisement of American Tool Companies, Inc., pp. 2-1 through 2-3 and 2-5 through 2-6. It is believed that the catalog was published in Oct. of 1997.

* cited by examiner

RELEASE EXPLOSION DAMPER

CROSS-REFERENCE TO RELATED APPLICATIONS

The present application claims priority benefits under 35 U.S.C. §371 to International Patent Application No. PCT/EP2005/005193, filed Mar. 12, 2005, International Patent Application No. PCT/EP2004/013979, filed Dec. 8, 2004, and German Patent Application No. 10 2004 024 862.1, filed May 19, 2004, all of which are incorporated herein by reference in their entirety.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND

1. Technical Field

The invention relates to a clamping and/or spreading tool, comprising a push or pull rod to which a movable jaw is fixed, a stationary jaw, a gear mechanism by which the movable jaw is movable towards or away from the stationary jaw by displacement of the push or pull rod in a clamping or spreading direction and by which clamping and/or spreading forces are applicable between the jaws, further comprising a lock which blocks displacement of the push or pull rod in opening direction opposite to the clamping or spreading direction so as to maintain the clamping and/or spreading forces generated between the jaws.

2. Background Art

DE 103 35 365 A1 discloses a clamping or spreading tool of this kind which can generate very great clamping forces between the stationary and movable jaws. To accomplish that, the pivot arm is pivotably mounted at a clamping side of the push or pull rod on a support which holds the stationary jaw. The point of contact at which the actuating arm can introduce actuating forces into an entraining slide element of the gear mechanism likewise is provided at the clamping side of the push or pull rod between the swivel joint and the push or pull rod. The leverage thus achieved is apt to provide clamping or spreading forces of up to 3000 Newton between the clamping jaws when the clamping tool is manipulated by one hand.

Once great tensioning forces have been generated, it may happen that actuation for release of the draw-back lock retaining the high tension will cause the movable jaw to be propelled explosively away from the stationary jaw. Analyses have clearly demonstrated that the clamping tool, especially the material of the clamping jaws, when tensioned, behaves like an elastic system deforming elastically in accordance with the tension created. Discharging of the clamping tool unloads the stored tension in correspondence with the modulus of elasticity inherent in the system by a shock-like movement of the push or pull rod in opening direction. The stored potential tensional energy is converted into kinetic energy of the push or pull rod. And it may happen that the push or pull rod is launched right through the support of the stationary jaw.

Since it is preferred to keep a low friction profile of the push rod within the support to permit easy displacement and adjustment of the push or pull rod, the release of very great tensional forces may let the push or pull rod, together with the movable jaw, glide through the support without any deceleration, whereby not only the workpiece to be treated may be damaged but also the person handling the tool may be hurt.

SUMMARY

It is an object of the invention to provide a clamping or spreading tool which permits the energy stored in the tensioned clamping or spreading tool to be discharged, especially non-explosively, at the same time warranting simple manipulation not susceptible of causing injury.

This object is met by the features of claim 1.

Thus a clamping and/or spreading tool comprises a push or pull rod to which a movable jaw is fixed, a stationary jaw, a gear mechanism by which the movable jaw is movable towards or away from the stationary jaw by displacement of the push or pull rod in a clamping or spreading direction and by which clamping and/or spreading forces are applicable between the jaws, and further comprises a lock which blocks displacement of the push or pull rod in opening direction opposite to the clamping or spreading direction so as to uphold the clamping and/or spreading forces generated between the jaws. In accordance with the invention, a conventional draw-back lock as described in DE 39 17 473 A1 or an entraining slide element canted with respect to the push or pull rod by coercive means, such as a compression spring, and embodied by a wedging plate which is capable of blocking the displacement of the push or pull rod due to its canting, may be regarded as the lock.

According to the invention the clamping and/or spreading tool comprises a mechanism for dissipating the clamping and/or spreading forces stored, said mechanism allowing especially controlled absorption displacement of the push or pull rod in opening direction along a predetermined, limited absorption path. The limitation of the absorption path is obtained by a blocking effect of the mechanism which does not come to bear until the absorption displacement of the push or pull rod in opening direction goes beyond the predetermined absorption path. And it blocks the further absorption displacement of the push or pull rod in opening direction with respect to the stationary jaw. The limitation of the absorption displacement may be removable to guarantee unblocked displacement of the push or pull rod for quick adjustment of the jaws.

The invention makes it possible to assure that the stored tensioning and/or spreading forces, when set free, will not let the push or pull rod become displaced in space like a projectile. Instead, loosening of the clamping and/or spreading tool will move the jaws only a little in opening direction, especially just a few millimetres, preferably without losing contact with the workpiece. During this absorption displacement at least part of the clamping and/or spreading forces, preferably all of these forces, will be dissipated by friction or damping. What remains of the clamping and/or spreading forces is retained by the blocking effect of the mechanism initiated after the absorption displacement. In this manner the dissipation of the stored clamping and/or spreading forces can be controlled, and the absorption displacement of the push or pull rod upon release of the tension is restricted to a desired extent.

In a further development of the invention the mechanism is adapted to be activated, especially by being actuated by the operator thereof, so that the absorption displacement of the push or pull rod in opening direction along the absorption path is allowed and carried out independently upon activation. After the absorption displacement a limitation of the absorption displacement takes hold automatically.

The mechanism, preferably, can be activated only upon release of the blocking effect of a lock, especially a draw-back lock.

According to a further development, the mechanism should be capable of being activated only by release of the tensioned clamping and/or spreading tool, especially of the lock which is charged by clamping and/or spreading forces. It is preferred that the mechanism be or remain inactive when the clamping and/or spreading tool is not tensioned, especially the lock is not charged.

With a preferred further development of the invention, the lock can be shifted essentially in opening direction with respect to the stationary jaw while the blocking effect is maintained to accomplish the absorption displacement. The blocking effect of the lock is to be understood as meaning that the displacement motion of the push or pull rod in opening direction with respect to the lock itself is blocked. When shifting the lock per se, the push or pull rod is allowed to move in opening direction, and this movement presents the predefined absorption displacement. The lock is arranged in a support in such a way that it can be shifted in opening direction while its blocking effect is upheld during shifting, the support carrying the stationary jaw and holding the push or pull rod for displacement.

A known clamping and/or spreading tool such as described in the above mentioned DE 103 35 365 A1 might be developed further by a mechanism according to the invention in that the spring biased release lever of the draw-back lock is supported so that it can be shifted, especially in opening direction, with respect to the support carrying the stationary jaw, for example, by an eccentric rotary member to be actuated by the operator. Shifting of the release lever, together with the push or pull rod which is canted with respect to the same, shortens the spring excursion of the elastically biased system at least in part, cancelling it entirely, if desired. The spring excursion is defined by elastically deformable clamping jaw parts of the clamping and/or spreading tool. And the elastic tensioning forces are dissipated.

Preferably, the lock can be shifted from a resting position in which it is set, especially forcibly upon actuation of the mechanism, into an absorption end position at which its blocking effect sets in. During shifting, the blocking effect of the lock prevents displacement of the push or pull rod with respect to the lock. Yet the push or pull rod, including the lock, is able to move in opening direction with respect to the stationary jaw. The shifting distance of the lock may be limited, especially by an abutment formed on the support.

The shifting distance travelled by the lock during absorption displacement, preferably, is equal or at least proportional to the predetermined absorption path.

In a preferred further development of the invention the mechanism includes a drive for shifting the lock in opening direction, together with the push or pull rod which is locked to the same. A drive may be provided for implementation by the operator, comprising an eccentric bearing for the lock. To implement an automatic drive, at least part of the clamping and/or spreading forces stored may be introduced into the lock to be shifted.

The blocking effect of the lock may be realized by forced canting of a plate-type lock with respect to the push or pull rod to block displacement of the push or pull rod in opening direction.

The mechanism, preferably, comprises two plate-type locks for blocking the displacement of the push or pull rod in opening direction. One of them may be shifted or moved with respect to the stationary jaw, essentially in opening direction, especially parallel to the push or pull rod, to provide the absorption displacement, while maintaining its forced canting. The other one is arranged stationarily with respect to the stationary jaw, while maintaining its forced canting.

In further development of the invention, the forced canting of the stationary plate-type lock may be lifted before lifting the forced canting of the shiftable plate-type lock, especially offset in time and/or distance.

When the forced canting of the stationary plate-type spring is lifted the clamping and/or spreading forces set free preferably can be introduced into the plate-type lock adapted to carry out shifting or translatory motion. They cause the shifting or displacing of the shiftable plate-type lock from a starting position into an end position at which further shifting is prevented.

In a particular embodiment of the invention, the shiftable plate-type lock comprises a wedging plate which is forcibly canted to the push or pull rod so that displacement of the push or pull rod with respect to the wedging plate in opening direction is blocked. The wedging plate contacts a movable place for engagement.

The wedging plate may be an entraining slide element of the gear mechanism embodied by a stepping gear. And the movable place for engagement is a location on the movable actuating arm of the stepping gear for transmitting the actuating force into the entraining slide element.

The actuating arm may adopt a mid position at which the actuating arm is positioned when unloaded by an operator, a stroke end position into which the actuating arm can be moved when actuated by an operator for displacing the push or pull roll in clamping or spreading direction, and an absorption end position, opposite to the stroke end position, into which the actuating arm can be moved for shifting the entraining slide element, while maintaining the forced canting thereof. In the latter position the actuating arm strikes against an abutment to present a limitation to the absorption displacement.

In a further development of the invention, the mechanism comprises a damper which dampens the absorption displacement of the push or pull rod along the absorption path. The damper, preferably, is activated only when the mechanism for absorption displacement of the push or pull rod in opening direction is activated. The damper may be formed by a centering spring, especially a compression spring which is adapted to be tensioned by shifting of the lock in opening direction. The centering spring may be disposed between a support holding the stationary jaw and the actuating arm. Alternatively, the damper may be formed by a catch means by which the clamping or spreading forces set free are damped by friction when the catch snaps into and out of engagement.

Preferably, the centering spring and a gear spring for canting the entraining slide element are tuned to each other in such a way that the actuating arm is forcibly located in mid position. From this position, lifting motion for the gear mechanism contrary to the gear spring and absorption motion for the mechanism contrary to the centering spring are allowed.

The centering spring which is tensioned in the absorption end position of the actuating arm can be relieved of tension by cancellation of the forced canting of the entraining slide element. It is especially the relaxing centering spring which urges the actuating arm into mid position.

BRIEF DESCRIPTION OF THE DRAWINGS

Further advantages, features, and characteristics of the invention will be described in the description below of a preferred embodiment, with reference to the accompanying drawings, in which.

DETAILED DESCRIPTION

Figure 1:
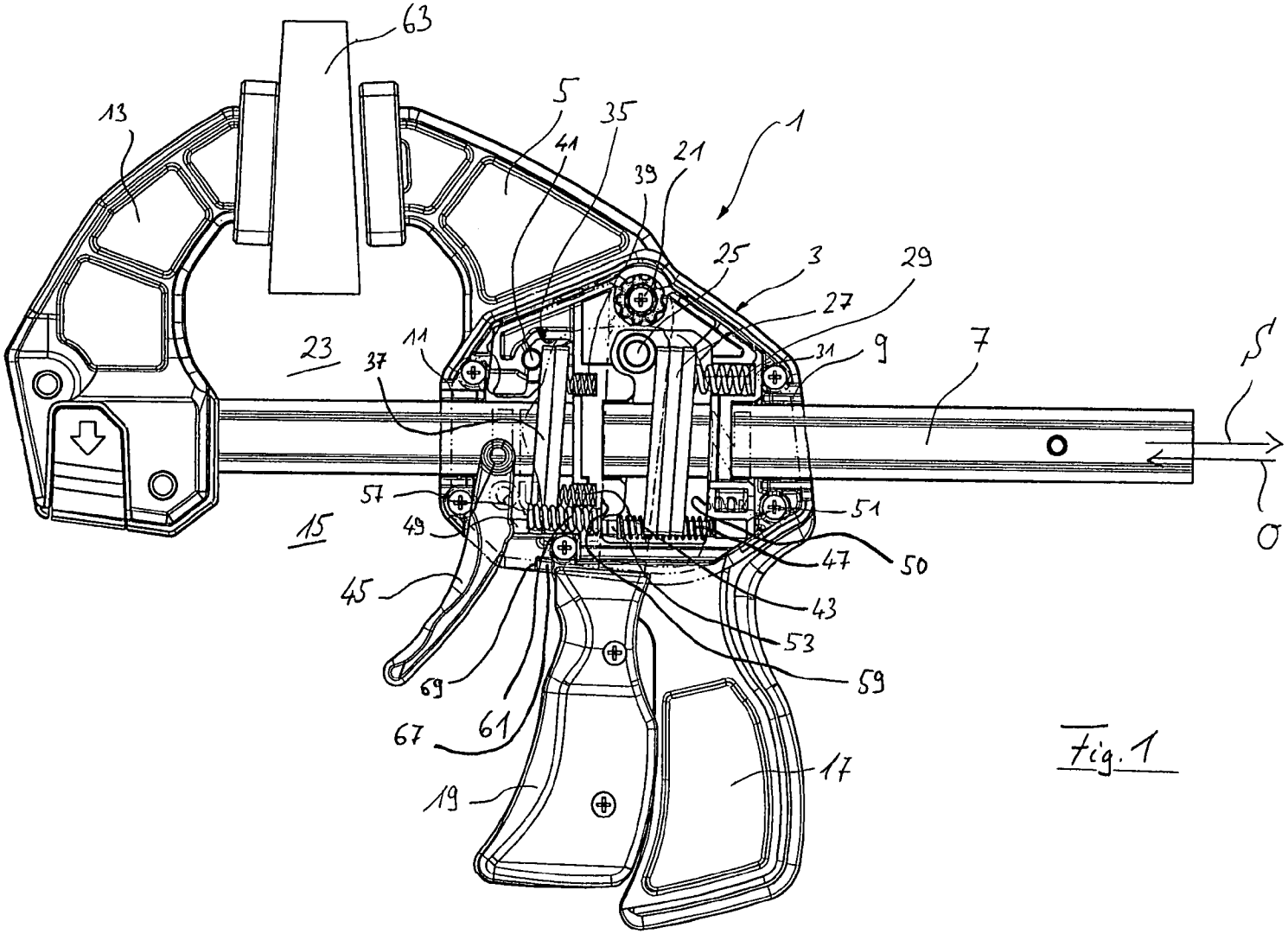
FIG. 1 is a side elevational view of an untensioned clamping and/or spreading tool according to the invention, showing a casing broken away for better viewing and free sections for better recognition of the interior of the stepping gear and the mechanism according to the invention.

The clamping tool 1 shown in FIGS. 1 to 5 comprises a support 3 on which a stationary jaw 5 is mounted and in which a push rod 7 is supported for displacement in longitudinal direction. Near the ends of the support 3, slide bearing portions 9 and 11 offering low sliding friction are provided to support the push rod 7.

A movable jaw 13 is removably mounted at one end of the push rod 7. It is oriented with respect to the stationary jaw 5 so as to create a clamping tool configuration, as may be seen in FIGS. 1 to 4. If the movable jaw 13 were to be mounted at the other end of the push rod 7 the configuration would be that of a spreading tool, not shown in the drawings.

A handle member 17 is formed integrally with the support 3 at an actuating side 15 of the push rod 7. An actuating arm 19 is pivoted to the support 3 in such manner as to allow swinging of the actuating arm 19 in the direction of the handle member 17. The actuating arm 19 is supported on the support 3 by means of a swivel joint 21 disposed at a clamping side 23 of the push or pull rod 7. Below the swivel joint 21, the actuating arm 19 has a cylindrical projecting stop 25 in engagement with entrainment plates of an entraining slide element 27.

The entraining slide element 27 is part of a stepping gear to be actuated by means of the actuating arm 19 for displacing the push rod 7 in spreading and/or clamping direction S. The stepping gear comprises a helical compression spring 29 disposed at the clamping side, oriented parallel to the push rod 7, and fitted under bias in a blind bore 31 formed in the support 3. The helical compression spring 29 acts on the entraining slide element 27 below the cylindrical projecting stop 25. The helical compression spring 29 in mounted under such bias as to swing the entraining slide element 27 in counterclockwise sense around the cylindrical projecting stop 25. Thereby the entraining slide element 27 enters into forced canting engagement with the push rod 7. Canting of the entraining slide member 27 results in blocking movement of the push rod 7 with respect to the entraining slide element 27 in opening direction O, opposite to the clamping and/or spreading direction S. The entraining slide element 27 thus acts in blocking sense on the displacement in opening direction O. Consequently the clamping forces generated between the clamping jaws 5 and 13 can be maintained when the projecting stop 25 has been moved in opening direction, stationary with respect to the support 3.

The stepping gear, moreover, comprises a draw-back lock 35 formed by a wedging plate 37 which is brought into canted blocking engagement with the push rod 7, like the entraining slide member 27, around a stationary point for engagement 41 of the support 3. A compression spring 39 disposed at the clamping side and a secondary spring 43 disposed at the actuating side cooperate to accomplish that. Arranging the compression spring 39 and the secondary spring 43 as a pair has the additional effect of preventing that the wedging plate 37, too, is shifted in clamping direction S due to friction when the push rod 7 is displaced in clamping direction S.

The draw-back lock 35 further comprises a release lever 45 to be actuated by an operator, especially with a forefinger, so as to enter into engagement with the lower end (covered up by component 61) of the wedging plate 37 to lift the canting thereof. The release lever 45 is in constant contact with a tappet 49 which is spring-(47)-biased and supported parallel to the push rod 7 in a longitudinal guideway 45 formed in the support 3. A return spring 47 is disposed between a projection 53 formed essentially in the middle of the tappet 49 and an abutment surface 50 of the support 3. Under bias, this spring serves to press the tappet 49 in the direction of the release lever 45.

A centering spring 61 is arranged between a spring stop 57 of the support 3 and an edge portion 59 of the actuating arm 19, attempting to urge the actuating arm 19 in the direction of the handle member 17. At the level of the support 3, the actuating arm 19 is shown in the drawing in dash-dot lines only for better recognition of the mechanism according to the invention.

When the actuating arm 19 is actuated, i.e. when the actuating arm 19 is pulled towards the handle member 17 the push rod is displaced in clamping direction S by virtue of the engagement of the projecting stop 25 with the entraining slide element 27. Hereby the workpiece 63 arranged between the clamping jaws 5 and 13 is gripped tight and clamping forces are imparted to the workpiece 63. A highly loaded, clamped workpiece 63 is to be seen in FIG. 2.

The description below relates only to the mechanism according to the invention for dissipating the stored clamping and/or spreading forces at the workpiece 63.

The basic concept of the mechanism according to the invention for dissipating the stored clamping and/or spreading forces resides in permitting a certain predetermined absorption displacement of the push rod 7 in opening direction O along a predetermined absorption path, with further displacement beyond the absorption path being blocked.

According to the invention, the absorption displacement may be obtained by shifting the lock which blocks the displacement of the push rod 7 in opening direction. In the embodiment illustrated in FIGS. 1 to 5, the lock is formed by the forcibly canted entraining slide element 27. The lock can be shifted because the entraining slide element 27 is movable in opening direction O, together with the push rod 7 canted to it, due to the pivotable projecting stop 27 of the actuating arm 19 which stop is capable of carrying out translatory motion in longitudinal direction of the push rod 7.

Figure 2:
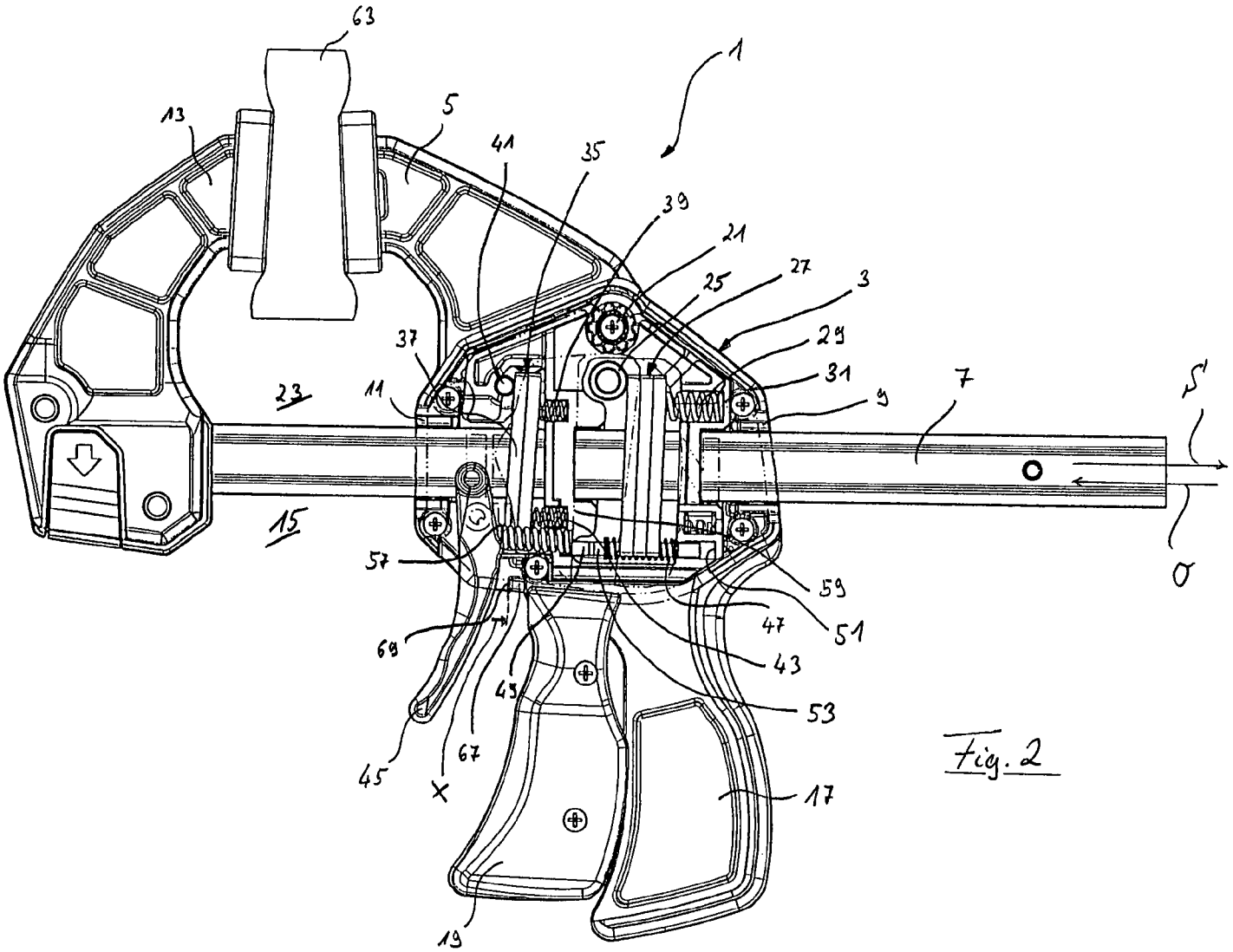
FIG. 2 is a side elevational view of the clamping and/or spreading tool according to FIG. 1, in tensioned state, with a release lever already having been partly actuated but not yet cancelling clamping forces.

Movability of the actuating arm 19 is granted by a free space 67 which allows clockwise swinging of the actuating arm 19 from the mid position illustrated in FIGS. 1 and 2 into an absorption end position (FIG. 3) at which the actuating arm 19 strikes against an abutment 69 formed on the support 3.

To make sure the actuating arm 19 does not get into the absorption end position (FIG. 3) during normal operation, in other words before tension stored between the clamping jaws 5 and 13 is relaxed, the centering spring 61 is tuned in consideration of the leverage to the swivel joint 21 and the leverage of the helical compression spring 29 to the projecting stop 25. When at mid position, the actuating arm 19 is offered a great lifting swing distance towards the handle member 17 and, by comparison, a relatively small absorption swing distance x (FIG. 2) towards the absorption end position.

It should be noted that the absorption swing distance x, i.e. the travel from mid position of the actuating arm 19 to the absorption end position thereof corresponds substantially to the absorption travel of the push rod 7 during which damping and dissipation are achieved of the tensioning forces set free.

The individual working steps of the mechanism for obtaining the desired controlled absorption displacement and the limitation of the absorption displacement of the push rod 7 will be described below.

FIG. 2 illustrates the clamping tool 1 in fully tensioned state which means that the workpiece 63 is under clamping load between the clamping jaws 5 and 13. The clamping jaws 5, 13 and the clamped workpiece 63 constitute an elastic system whose modulus of elasticity is determined by the materials used. The exaggerated dumbbell deformation of the workpiece 63 shown in the fig. is intended to demonstrate the elasticity of the system.

The clamping forces acting between the clamping jaws 5 and 13 were generated by the stepping gear upon actuation of the actuating arm 19. When the operator (not shown) lets go the actuating arm 19 the helical compression spring 29 moves the actuating arm 19 into mid position, shown in FIGS. 2 and 1. The centering spring 61 keeps the actuating arm 19 away from the abutment 69.

When the clamping tool 1 is in the tensioned state shown in FIG. 2 the clamping forces are held only by the draw-back lock 35. The blocking effect of the entraining slide element 27 is inactive since the canted entraining slide element 27 cannot yet take up any forces because of the shiftability of the projecting stop 25 in opening direction O.

To release the clamping forces stored, in other words to discharge the workpiece 63 of the tensioning load, the operator actuates the release lever 45. In a first step of release, indicated in FIG. 3, the release lever 45 is pulled further back, beyond the intermediate position shown in FIG. 2, until the wedging plate 37 is relieved of its canting to the push rod 7. To this end, the release lever 45 presses against the lower end (not visible) of the wedging plate 37, changing the position thereof in counterclockwise sense into a substantially vertical one. Hereby the blocking effect of the draw-back lock 35 is cancelled. Due to the release of the draw-back lock 35 the elastic system composed of deformed clamping jaws and workpiece relaxes, as expected, displacing the push rod 7 with respect to the support 3 in opening direction O. At the same time, the entraining slide element 27 canted to the push rod 7 is shifted in correspondence with the absorption swing distance x in opposition to the centering spring 61 until the actuating arm 19 strikes against the abutment 69.

Figure 3:
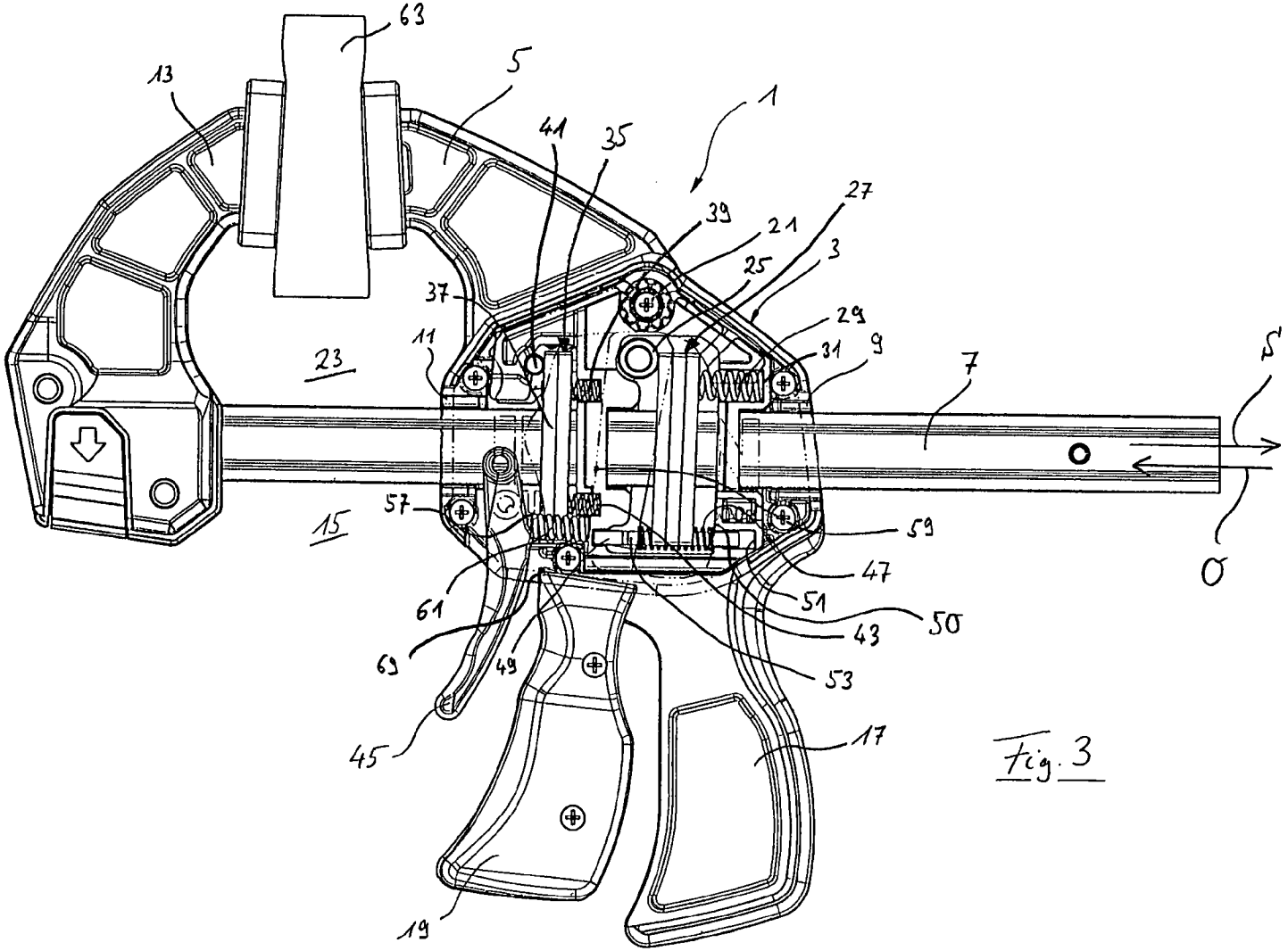
FIG. 3 is a side elevational view of the clamping and/or spreading tool according to FIGS. 1 and 2, showing the mechanism according to the invention in an intermediate phase in which the clamping forces are cancelled only partly.

It is obvious that at the intermediate step of release, shown in FIG. 3, the wedging plate 37 is no longer canted and the actuating arm 19 is in its absorption end position. At this time, the centering spring 61 is compressed. Part of the clamping forces has been dissipated, as indicated by the less strongly deformed workpiece 63.

The blocking effect of the entraining slide element 27 cannot take hold immediately upon release of the draw-back lock 35 because, when in mid position, the actuating arm 19 is not fixed in clockwise sense. Instead an absorption path x exists by virtue of the free space 67. It is only when the actuating arm 19 is stopped by the abutment 69 and the projecting stop 25 is fixed in opening direction O that blocking becomes effective. This delayed entering into effect of the blocking by the canted entraining slide element 27 stops the absorption movement of the push rod 7 in opening direction.

Moreover, by overcoming the centering spring 61, the absorption displacement of the actuating arm 19 and of the push rod 7 is damped. In this manner the clamping forces released which cause the push rod 7 to become displaced in opening direction O are partly dissipated, on the one hand, by frictional losses of the movement of the actuating arm 19 and the push rod 7 in opening direction O and, on the other hand, by the build-up of tension of the centering spring 61. The remaining clamping forces are upheld by canting of the entraining slide element 27.

Figure 4:
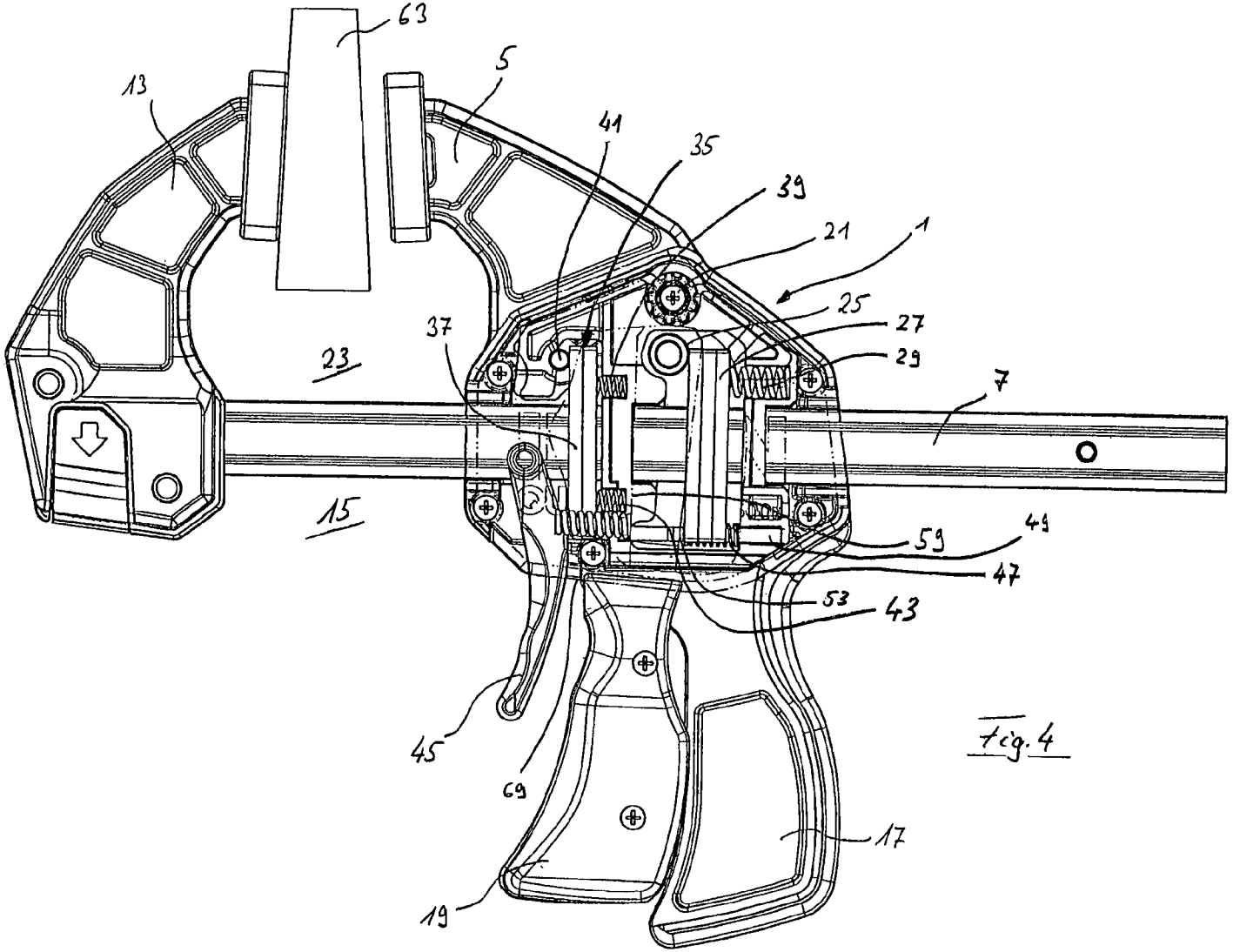
FIG. 4 is a side elevational view of the clamping and/or spreading tool according to FIGS. 1 to 3, showing the mechanism according to the invention in a final phase in which the clamping forces are cancelled completely.

It is only when the release lever 45 is pressed further, as shown in FIG. 4 that the entraining projection 53 takes along the entraining slide element 27 allowing it to swing in clockwise sense around the projecting stop 25. Hereby the canted engagement between the entraining slide element 27 and the push rod 7 is lifted and thus the locking or blocking effect of the entraining slide element 27 is cancelled. FIG. 4 shows this final release step with the release lever 45 pulled all the way.

When both locks, the draw-back lock 35 and the blocking entraining slide element 27 of the gear mechanism, have become fully loosened the desired possibility of free shifting of the push rod 7 at fully actuated release lever 45 can be warranted. In this condition the operator can let the push rod 7 slide through the support 3 under the influence of its weight.

Figure 5:
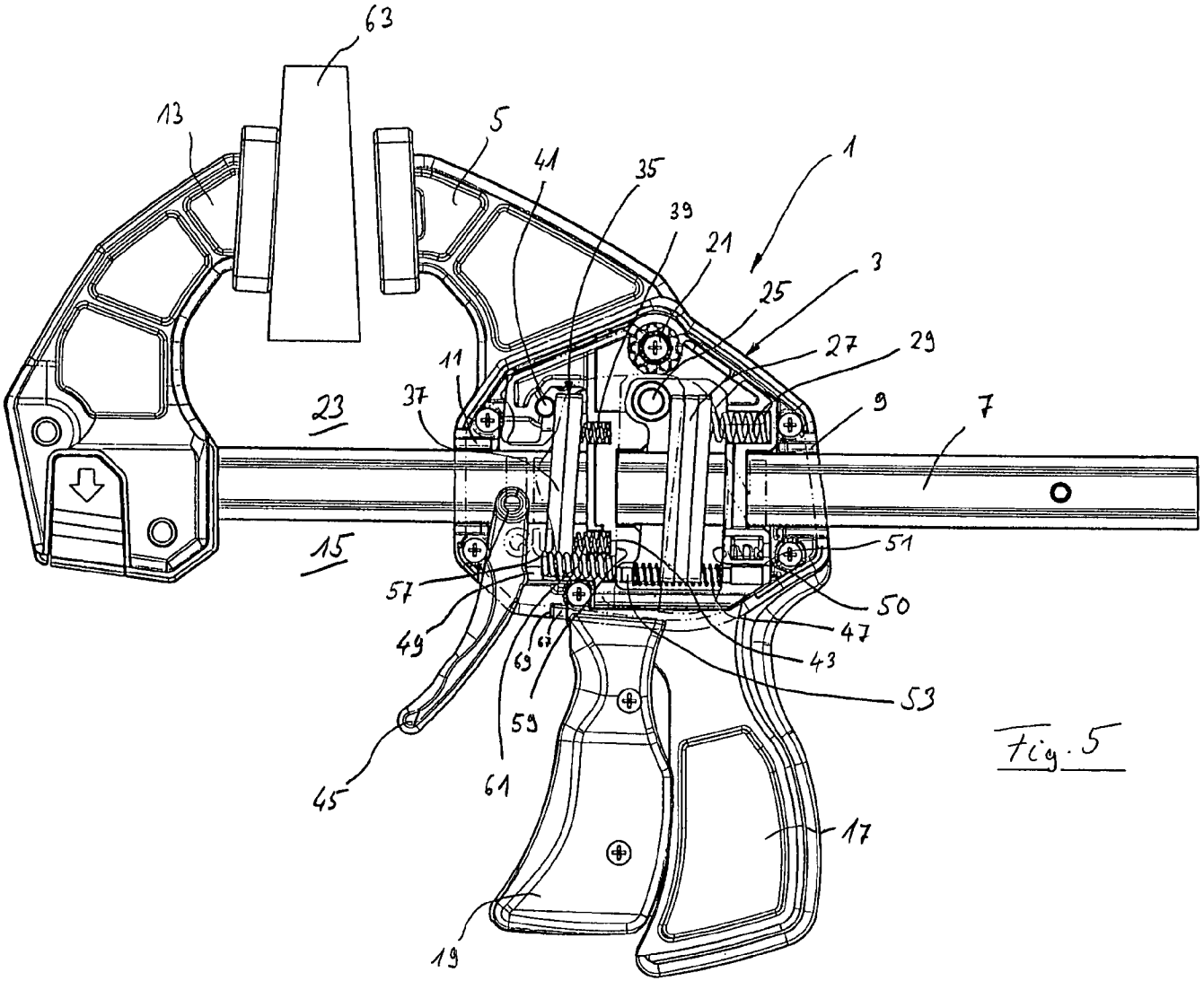
FIG. 5 is a side elevational view of the clamping and/or spreading tool according to FIGS. 1 to 4, showing the release lever of the mechanism according to the invention in non-actuated state.

When the release lever 45 is let go the return spring 47 presses the release lever 45 via the tappet 49 back into the starting position of the stepping gear and the mechanism, shown in FIG. 5. At the same time, the engagement of the entraining projection 53 lifting the canting of the entraining slide element is cancelled, and subsequently the blocking effect of the draw-back lock 35 caused by canting is reestablished by freeing the lower end of the wedging plates 37.

When the blocking effect of the entraining slide element 27 is given up the actuating arm 19 is moved back into the mid position illustrated in FIG. 5 since there is no resistance and the centering spring 61 is stronger with the actuating arm 19 in this position.

The features disclosed in the specification above, in the figures and drawings may be significant for implementing the invention in its various embodiments, both individually and in any combination.

The invention claimed is:

1. A clamping or spreading tool, comprising:

a push or pull rod to which a movable jaw is fixed;

a stationary jaw;

a gear mechanism by which the movable jaw is movable towards or away from the stationary jaw by displacement of the push or pull rod in a clamping or spreading direction and by which clamping or spreading forces are applied between the jaws;

a lock that blocks displacement of the push or pull rod in an opening direction opposite to the clamping or spreading direction so as to maintain the clamping or spreading forces generated between the jaws; and a force dissipating mechanism for dissipating the clamping or spreading forces stored that allows absorption displacement of the push or pull rod in the opening direction along a predetermined absorption path and blocks absorption displacement of the push or pull rod in the opening direction beyond the predetermined absorption path upon release of the lock, said force dissipating mechanism including a release lever to release the lock and an entraining slide element to block the absorption displacement of the push or pull rod in the opening direction beyond the predetermined absorption path upon release of the lock wherein said release lever has a contacting member which is offset and contacts a entrailing projection thereby producing said absorption displacement.

2. The clamping or spreading tool as claimed in claim 1, wherein the force dissipating mechanism is adapted to be activated by an operator such that, upon activation, the absorption displacement of the push or pull rod in the opening direction along the absorption path is allowed independently and, after the absorption displacement, an absorption displacement limitation takes hold automatically.

3. The clamping or spreading tool as claimed in claim 1, wherein the force dissipating mechanism can be activated only upon release of the blocking effect of the lock.

4. The clamping or spreading tool as claimed in claim 1, wherein the force dissipating mechanism can be activated when clamping or spreading forces are held at the lock.

5. The clamping or spreading tool as claimed in claim 1, wherein the force dissipating mechanism is or remains deactivated when the tool is not tensioned.

6. The clamping or spreading tool as claimed in claim 1, wherein the lock is shiftable essentially in the opening direction with respect to the stationary jaw, while maintaining its blocking effect, so as to provide the absorption displacement.

7. The clamping or spreading tool as claimed in claim 1, wherein the lock is arranged in a support in such a way as to be shiftable in the opening direction while its blocking effect is upheld, the support carrying the stationary jaw and holding the push or pull rod for displacement.

8. The clamping or spreading tool as claimed in claim 6, wherein the lock is shiftable from a resting position in which it may be forcibly adjusted upon activation of the force dissipating mechanism into an absorption end position.

9. The clamping or spreading tool as claimed in claim 6, wherein shiftability of the lock is limited by an abutment formed on the support.

10. The clamping or spreading tool as claimed in claim 6, wherein the shift distance travelled by the lock during absorption displacement substantially equals the predetermined absorption path.

11. The clamping or spreading tool as claimed in claim 1, wherein the force dissipating mechanism comprises a drive for shifting the lock, with the push or pull rod-locked to the lock in the opening direction.

12. The clamping or spreading tool as claimed in claim 11, wherein a the drive is to be implemented by an operator and comprises an eccentric bearing for the lock, such that at least part of the clamping or spreading forces can be introduced into the lock to be shifted.

13. The clamping or spreading tool as claimed in claim 1, wherein the lock is formed by a plate-type lock which is forcibly canted with respect to the push or pull rod to block displacement of the push or pull rod in the opening direction.

14. The clamping or spreading tool as claimed in claim 1, wherein the force dissipating mechanism comprises two plate-type locks, one of which is shiftable with respect to the stationary jaw essentially in the opening direction for providing the absorption displacement while the forced canting with respect to the push or pull rod is upheld, whereas the other one is arranged stationarily with respect to the stationary jaw, maintaining the forced canting with respect to the push or pull rod.

15. The clamping or spreading tool as claimed in claim 14, herein the forced canting of the stationary plate-type lock can be lifted before the forced canting of the shiftable plate-type lock.

16. The clamping or spreading tool as claimed in claim 14, wherein the clamping or spreading forces released upon lifting of the forced canting of the stationary plate-type lock can be introduced into the shiftable plate-type lock such that the shiftable plate-type lock, together with the push or pull rod canted with respect to the same, are shifted from a starting position into and end position at which further shifting is prevented.

17. The clamping or spreading tool as claimed in claim 14, wherein the shiftable plate-type lock comprises a wedging plate which is forcibly canted to the push or pull rod so that displacement of the push or pull rod in the opening direction with respect to the wedging plate is blocked, said wedging plate contacting a movable place for engagement.

18. The clamping or spreading tool as claimed in claim 17, wherein the wedging plate constitutes an entraining slide element of the gear mechanism designed as a stepping gear, and the movable place for engagement is presented by the location of power transmission from the entraining slide element into a movable, swingable actuating arm of the stepping gear.

19. The clamping or spreading tool as claimed in claim 18, wherein the actuating arm has a mid position at which the actuating arm is positioned when unloaded, a stroke end position into which the actuating arm can be moved when actuated by an operator to displace the push or pull rod in the clamping or spreading direction, and an absorption end position, opposed to the stroke end position, into which the actuating arm can be moved for shifting the entraining slide element, while maintaining the forced canting thereof, and at which the actuating arm strikes against an abutment present on a support for providing limitation of the absorption displacement.

20. The clamping or spreading tool as claimed in claim 1, wherein the force dissipating mechanism comprises a damper which dampens the absorption displacement of the push or pull rod along the absorption path.

21. The clamping or spreading tool as claimed in claim 20, wherein the damper is activated only when the force dissipating mechanism for absorption displacement of the push or pull rod is the opening direction is activated.

22. The clamping or spreading tool as claimed in claim 20, further comprising an actuating arm that operatively engages the entraining slide element, and wherein the damper is formed by a centering spring comprising a compression spring adapted to be tensioned by shifting of the lock essentially in the opening direction.

23. The clamping or spreading tool as claimed in claim 22, wherein the centering spring is disposed between a support which holds the stationary jaw and the actuating arm.

24. The clamping or spreading tool as claimed in claim 22, wherein the centering spring and a gear spring for canting the entraining slide element are harmonized such that the actuating arm is forcibly positioned in a mid position out of which lifting motion for the gear mechanism contrary to the gear spring and absorption motion for the force dissipating mechanism contrary to the centering spring are allowed.

25. The clamping or spreading tool as claimed in claim 22, wherein the centering spring tensioned in the absorption end position of the actuating arm can be relieved of tension by lifting the forced canting of the entraining slide element, the relaxing centering spring, at the same time, urging the actuating arm into the mid position.

26. A clamping or spreading tool, comprising:

a push or pull rod to which a movable jaw is fixed;

a stationary jaw;

a gear mechanism by which the movable jaw is movable towards or away from the stationary jaw by displacement of the push or pull rod in a clamping or spreading direction and by which clamping or spreading forces are applied between the jaws;

a lock that blocks displacement of the push or pull rod in an opening direction opposite to the clamping or spreading direction so as to maintain the clamping or spreading forces generated between the jaws; and a force dissipating mechanism for dissipating the clamping or spreading forces stored that allows absorption displacement of the push or pull rod in the opening direction and blocks absorption displacement of the push or pull rod in the opening direction beyond a predetermined distance upon release of the lock, wherein the force dissipating mechanism comprises two plate-type locks, one of which is shiftable with respect to the stationary jaw essentially in the opening direction for providing the absorption displacement while the forced canting with respect to the push or pull rod is upheld, whereas the other one is arranged stationarily with respect to the stationary jaw, maintaining the forced canting with respect to the push or pull rod wherein said release lever has a contacting member which is offset and contacts a entrailing projection thereby producing said absorption displacement.

27. A clamping or spreading tool, comprising:

a push or pull rod to which a movable jaw is fixed;

a stationary jaw;

a gear mechanism by which the movable jaw is movable towards or away from the stationary jaw by displacement of the push or pull rod in a clamping or spreading direction and by which clamping or spreading forces are applied between the jaws;

a lock that blocks displacement of the push or pull rod in an opening direction opposite to the clamping or spreading direction so as to maintain the clamping or spreading forces generated between the jaws; and means for dissipating the clamping or spreading forces stored that allows absorption displacement of the push or pull rod in the opening direction along a predetermined absorption path and blocks absorption displacement of the push or pull rod in the opening direction beyond the predetermined absorption path upon release of the lock.

28. A clamping or spreading tool, comprising:

a push or pull rod to which a movable jaw is fixed;

a stationary jaw;

a gear mechanism by which the movable jaw is movable towards or away from the stationary jaw by displacement of the push or pull rod in a clamping or spreading direction and by which clamping or spreading forces are applied between the jaws;

a lock that blocks displacement of the push or pull rod in an opening direction opposite to the clamping or spreading direction so as to maintain the clamping or spreading forces generated between the jaws; and a force dissipating mechanism for dissipating the clamping or spreading forces stored that allows absorption displacement of the push or pull rod in the opening direction along a predetermined absorption path and blocks absorption displacement of the push or pull rod in the opening direction beyond the predetermined absorption path upon release of the lock, said force dissipating mechanism including:

a release lever to release the lock;

an entraining slide element to block the absorption displacement of the push or pull rod in the opening direction beyond the predetermined absorption path upon release of the lock; and an actuating arm operatively engaging the entraining slide element, the actuating arm including a pivotable projecting stop for carrying out translatory motion in the longitudinal direction of the push rod to allow shifting of the entraining slide element.

29. The clamping or spreading tool as claimed in claim 28, wherein the actuating arm has a mid position at which the actuating arm is positioned when unloaded, a stroke end position into which the actuating arm can be moved when actuated by an operator to displace the push or pull rod in the clamping or spreading direction, and an absorption end position, opposed to the stroke end position, into which the actuating arm can be moved for shifting the entraining slide element, while maintaining the forced canting thereof, and at which the actuating arm strikes against an abutment present on a support for providing limitation of the absorption displacement.

* * * * *

UNITED STATES PATENT AND TRADEMARK OFFICE

CERTIFICATE OF CORRECTION

PATENT NO. : 7,942,392 B2
APPLICATION NO. : 10/572607
DATED : May 17, 2011
INVENTOR(S) : Manfred Geier et al.

It is certified that error appears in the above-identified patent and that said Letters Patent is hereby corrected as shown below:

On the cover page, at "(75) Inventors:" change "Puchhelm (DE)" to --Puchheim (DE)--.

On the cover page, change the PCT Filed date at (22) from "Mar. 12, 2005" to --May 12, 2005--.

Column 9, cancel the text at lines 12-15 that is in claim 1 and insert:

--upon release of the lock, wherein said release lever includes a contacting member which is offset from and contacts an elongated member with a projection extending therefrom, thereby allowing said absorption displacement.--.

Column 9, cancel the text at lines 6-17 that is in claim 2 and insert:

--2. The clamping or spreading tool as claimed in claim 1, wherein the means for dissipating is adapted to be--.

Column 9, cancel the text at lines 23-24 that is in claim 3 and insert:

--3. The clamping or spreading tool as claimed in claim 1, wherein the means for dissipating can be activated--.

Column 9, cancel the text at lines 26-27 that is in claim 4 and insert:

--4. The clamping or spreading tool as claimed in claim 1, wherein the means for dissipating can be activated--.

Signed and Sealed this
Third Day of April, 2012

David J. Kappos

David J. Kappos
*Director of the United States Patent and Trademark Office*

Column 9, cancel the text at lines 29-30 that is in claim 5 and insert:

--5. The clamping or spreading tool as claimed in claim 1, wherein the means for dissipating is or remains deac- --.

Column 9, cancel the text at line 32 that is in claim 6 and insert:

--6. The clamping or spreading tool as claimed in claim 1,--.

Column 9, cancel the text at line 36 that is in claim 7 and insert:

--7. The clamping or spreading tool as claimed in claim 1,--.

Column 9, cancel the text at lines 43-44 that is in claim 8 and insert:

--it may be forcibly adjusted upon activation of the means for dissipating into an absorption end position.--.

Column 9, cancel the text at lines 52-53 that is in claim 11 and insert:

--11. The clamping or spreading tool as claimed in claim 1, wherein the means for dissipating comprises a drive--.

Column 9, cancel the text at line 61 that is in claim 13 and insert:

--13. The clamping or spreading tool as claimed in claim 1,--.

Column 9, cancel the text at lines 65-66 that is in claim 14 and insert:

--14. The clamping or spreading tool as claimed in claim 1, wherein the means for dissipating comprises two--.

Column 10, cancel the text at lines 44-45 that is in claim 20 and insert:

--20. The clamping or spreading tool as claimed in claim 1, wherein the means for dissipating comprises a damper--.

Column 10, cancel the text at lines 49-51 that is in claim 21 and insert:

--wherein the damper is activated only when the means for dissipating for absorption displacement of the push or pull rod in the opening direction is activated.--.

Column 10, cancel the text at lines 66-67 that is in claim 24 and insert:

--spring and absorption motion for the means for
dissipating contrary to the centering spring are allowed.--.

Column 11, cancel the text at lines 32-34 that is in claim 26 and insert:

--canting with respect to the push or pull rod, wherein said
release lever includes a contacting member which is offset from
and contacts an elongated member with a projection extending therefrom, thereby allowing--.